US005936211A

United States Patent [19]

Kim

[11] Patent Number: 5,936,211

[45] Date of Patent: Aug. 10, 1999

[54] ELEVATOR CONTROL SYSTEM

[75] Inventor: Yeon Hun Kim, Changwon, Rep. of Korea

[73] Assignee: LG Industrial Systems Co., Ltd, Seoul, Rep. of Korea

[21] Appl. No.: 08/992,219

[22] Filed: Dec. 17, 1997

[30] Foreign Application Priority Data

Dec. 17, 1986 [KR] Rep. of Korea ..... 96/66645

[51] Int. Cl.[6] ..... B66B 1/28

[52] U.S. Cl. ..... 187/248; 187/382

[58] Field of Search ..... 187/248, 247, 187/380, 382

[56] References Cited

U.S. PATENT DOCUMENTS

| | | | |
|---|---|---|---|
| 4,114,730 | 9/1978 | Means et al. | 187/247 |
| 4,326,606 | 4/1982 | Kuzunuki et al. | 187/248 |
| 4,350,255 | 9/1982 | Sakata et al. | 187/248 |
| 4,497,391 | 2/1985 | Mendelsohn et al. | 187/29 R |
| 4,567,560 | 1/1986 | Polis et al. | 364/184 |
| 4,872,532 | 10/1989 | Tobita et al. | 187/391 |
| 4,989,695 | 2/1991 | Kubo | 187/247 |
| 5,092,431 | 3/1992 | Schroder | 187/127 |
| 5,142,107 | 8/1992 | Yasuhiro | 187/247 |
| 5,202,540 | 4/1993 | Auer et al. | 187/247 |

*Primary Examiner*—Robert E. Nappi

[57] ABSTRACT

The elevator control system includes a plurality of car controllers which control respective operations of a plurality of elevator cars, and at least one column of hall terminals. Each hall terminal in a column of hall terminals controls input/output operations relevant to present running display units for the elevator cars, a hall call button unit and arrival notice unit provided at a floor of the building associated with the hall call terminal. A communication relay system relays communication between the plurality of car controllers and the plurality of hall terminals. The communication relay system includes a plurality of slave communication units, each of which corresponds to a column of hall terminals and receives/transmits data from/to the corresponding column of hall terminals. A master communication unit receives/transmits data from/to the plurality of car controllers and the slave communication units.

15 Claims, 9 Drawing Sheets

ELEVATOR CONTROL SYSTEM

BACKGROUND OF THE INVENTION

1. Field of the Invention

The present invention relates to an elevator control system adopting a group management system, and more particularly to an improved communication apparatus for an elevator control system capable of allowing a communication relay system responsible for a signal reception/transmission between a plurality of car controllers or a group management controller and a plurality of hall terminals to independently process data signals outputted from the hall terminals.

2. Description of the Background Art

FIG. 1 is a block diagram illustrating a conventional communication apparatus for an elevator control system. As shown therein, the communication apparatus includes: a plurality of car controllers 11A–11N for controlling respective operations of a plurality of elevator cars; a group management controller 12 for carrying out a common operation with regard to the plurality of elevator cars; a plurality of hall terminals 14A–14N, 15A–15N for controlling an input/output with regard to a plurality of present running floor display devices, hall call button units, arrival notice units and the like, and being disposed at floor halls with the number corresponding to the hall call buttons; and a communication relay system 13 for relaying data between the car controllers 11A–11N and the group management controller 12 and the hall terminals 14A–14N, 15A–15N via a group network GNW and a hall network HNW. Therein, the group network GNW and the hall network HNW respectively denote a common serial transmission line, and the hall terminals 14A–14N, 15A–15N are selectively disposed in each floor by the number thereof corresponding to the hall call buttons.

Here, present running floor display devices which are not drawn in FIG. 1 respectively serve to display a present running floor of an elevator car. The hall call button unit outputs a signal corresponding to a hall call in accordance with a passenger's call. The arrival notice unit displays a moving direction of an elevator car. And each of the present running floor display devices, the hall call button units, and the arrival notice units are disposed at each floor hall.

For instance, when a ten-story building is provided with four elevator cars and two hall call button units on each floor thereof, there are required twenty hall terminals. On the top and ground floor halls there are respectively provided one hall call button unit, and on each of the rest floors there are provided two hall button units; one at a top portion, the other at a bottom portion, on the respective floors between the ground and the top floor.

The operation of the thusly constituted conventional communication apparatus for an elevator control system will now be described.

Each of the hall terminals 14A–14N, 15A–15N respectively disposed at a corresponding floor hall receives signals from a present running floor display device, a hall call button unit, an arrival notice unit, and transmits the received signals through a hall network HNW serving as a common serial communication line to the communication relay system 13. The communication relay system 13 determines which floor the received signals are from (for example, input signals from a third floor of a first row), and which signals they are (for example, whether the elevator car call is for normal or disabled passengers or for VIPs, or the received signals are from a hall terminal number setting switch), whereby the resultant signals are transmitted through the group network GNW serving as a common serial communication line to the group management controller 12.

If the received signals are relevant to a car call, the group management controller 12 selects an appropriate car and allocates the car call to the car controllers 11A–11N which control the selected car. If the received signals are related to a car running pattern, a corresponding control command is transmitted to the respective car controllers 11A–11N. The communication between the group management controller 12 and the car controllers 11A–11N is carried out by use of a serial communication method through the group network GNW.

Also, the signals applied from the car controllers 11A–11N or the group management controller 12 to the hall terminals 14A–14N, 15A–15N are serially transmitted through the group network GNW to the communication relay system 13. The output data of the communication relay system 13 are serially transmitted through the hall network HNW to the hall terminals 14A–14N, 15A–15N. Here, if the received data are relevant to the hall terminals 14A–14N, 15A–15N themselves, they are appropriately processed and sent to corresponding appliances.

The thusly obtained data may vary to an answering signal (call register signal) to the hall call, a direction signal for notifying a car running direction, and a present location display signal of the elevator car.

Meanwhile, in the case there is provided a system in which the plurality of car controllers 11A–11N and the group management controller 12 are connected to the single common serial transmission line GNW, and the hall terminals 14A–14N, 15A–15N are connected to the single common serial transmission line HNW, the more floors a building has, the more frequently there occurs an increased communication charge rate, a communication congestion or a communication data collision, thereby deteriorating a system efficiency thereof. Although those disadvantages may be overcome to a certain extent by the so far proposed relevant arts, there still remain problems as follows.

First, in order to determine which hall terminal the signals applied to the communication relay system 13 are from, the respective hall terminals 14A–14N, 15A–15N should be assigned identification numbers ID, and switching devices for setting the identification number ID serving as a code that discerns the hall terminals 14A–14N, 15A–15N should be provided in the respective hall terminals 14A–14N, 15A–15N. Here, the entire hall terminals 14A–14N, 15A–15N are connected to the hall network HNW serving as the single common serial communication line so that there should be respectively determined which floor and which hall button unit the respective hall terminals 14A–14N, 15A–15N are disposed for, thereby further complicating an installation thereof.

Secondly, there is a disadvantage relevant to a communication charge rate for the single common serial transmission line HNW which serves to couple the respective hall terminals 14A–14N, 15A–15N with the communication relay system 13. The more cars and floors in a building, the more hall call buttons there should be provided accordingly, whereby the thusly congested communication load may result in collisions between communication data.

Thirdly, a breakdown of the communication relay system 13 may damage the reliability of the system. When the communication relay system 13 is provided with a single CPU, any erroneous operations of the CPU or breakdowns of the communication relay system 13 may result in a communication path interruption with regard to the hall terminals 14A–14N, 15A–15N, thereby disabling hall call data reception and accordingly damaging the system reliability.

Fourthly, there comes a supply power with regard to the communication relay system 13 and the hall terminals 14A–14N, 15A–15N. When supply power required for the communication relay system 13 and the respective hall terminals 14A–14N, 15A–15N is supplied from either of the group management controller 12 and the respective car controllers 11A–11N, and when there occurs an error to the supply power that is to be provided to the group management controller 12 or the respective car controllers 11A–11N, the communication relay system 13 becomes disabled. Accordingly, although other controllers are operating normally input signals of the respective halls are not received via the communication relay system 13. In order to overcome this disadvantage, there may be provided relays or contactors in the group management controller 12 and the respective car controllers 11A–11N, and respective contact nodes between the relays and the contractors may be combined with each other. Here, if there does not occur a simultaneous error with regard to the entire control devices, power becomes supplied to the communication relay system 13 and the hall terminals 14A–14N, 15A–15N by use of a selected control device. However, in this case, the combination in the contact nodes tends to be complicated and each control device should be provided with a required capacity of supply power, thereby incurring otherwise unnecessary cost.

That is, the supply power outputted from the car controllers 11A–11N is supplied to the communication relay system 13 and the hall terminals 14A–14N, 15A–15N, so that there may occur an error to the power devices of the car controllers. Also, by turning off a main power breaker which is provided in the car controllers 11A–11N for the purpose of maintenance/checkup, the supply power to the communication relay system 13 or the hall terminals 14A–14N, 15A–15N may be turned off, thereby failing transmission of input signals generated in the halls.

As described above, in a communication apparatus for an elevator control system, there have yet to be solved such problems as a communication charge rate with regard to a hall network, a reliability of the system which is provided for the communication relay system, an identification number allocation method for discerning installation locations of the respective hall terminals, and a power supply to the communication relay system and the plurality of hall terminals.

SUMMARY OF THE INVENTION

Therefore, it is an object of the present invention to provide a communication apparatus for an elevator control system capable of minimizing a non-workability of an elevator system when there occurs a breakdown and simplifying an identification number setting method with regard to hall terminals provided at respective hall button unit columns, by separately providing power to a communication relay system and the respective hall terminals.

To achieve the above-described object, a communication apparatus for an elevator control system provided with a plurality of car controllers which control respective operations of a plurality of elevator cars, a plurality of hall terminals for controlling input/output operations relevant to present running display units for the elevator cars, hall call button units and arrival notice units provided at each floor of a building, and for being disposed at said each floor of the building so as to correspond to the number of the hall button units, a communication relay system for relaying communications between the plurality of car controllers and the plurality of hall terminals, and a first common serial transmission line for receiving/transmitting data between the communication relay system and the car controllers, includes a plurality of slave communication units for receiving/transmitting data from/to the plurality of hall terminals which belong to a corresponding one of a plurality of hall call button unit columns, a master communication unit for receiving/transmitting data from/to the plurality of car controllers and the plurality f slave communication units, and a second common serial communication line for coupling the master communication unit and the plurality of slave communication units.

The slave communication units are connected depending upon the respective hall call button unit columns and accordingly processes data relevant to the hall terminals, thereby decreasing a communication load rate, and because identification numbers for discerning the hall call button columns are not required to the hall terminals, thereby further simplifying the composition of the hall terminals.

Further, the communication apparatus for an elevator control system according to the present invention is provided with a double system including the first and second communication units which are identically operated in the communication relay system for supervising each other, thereby improving a system reliability.

Still further, the communication relay system and the power supply for the respective hall terminals are separately provided for thereby stabilizing a power supply mechanism.

The object and advantages of the present invention will become more readily apparent from the detailed description given hereinafter. However, it should be understood that the detailed description and specific examples, while indicating the preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 1:
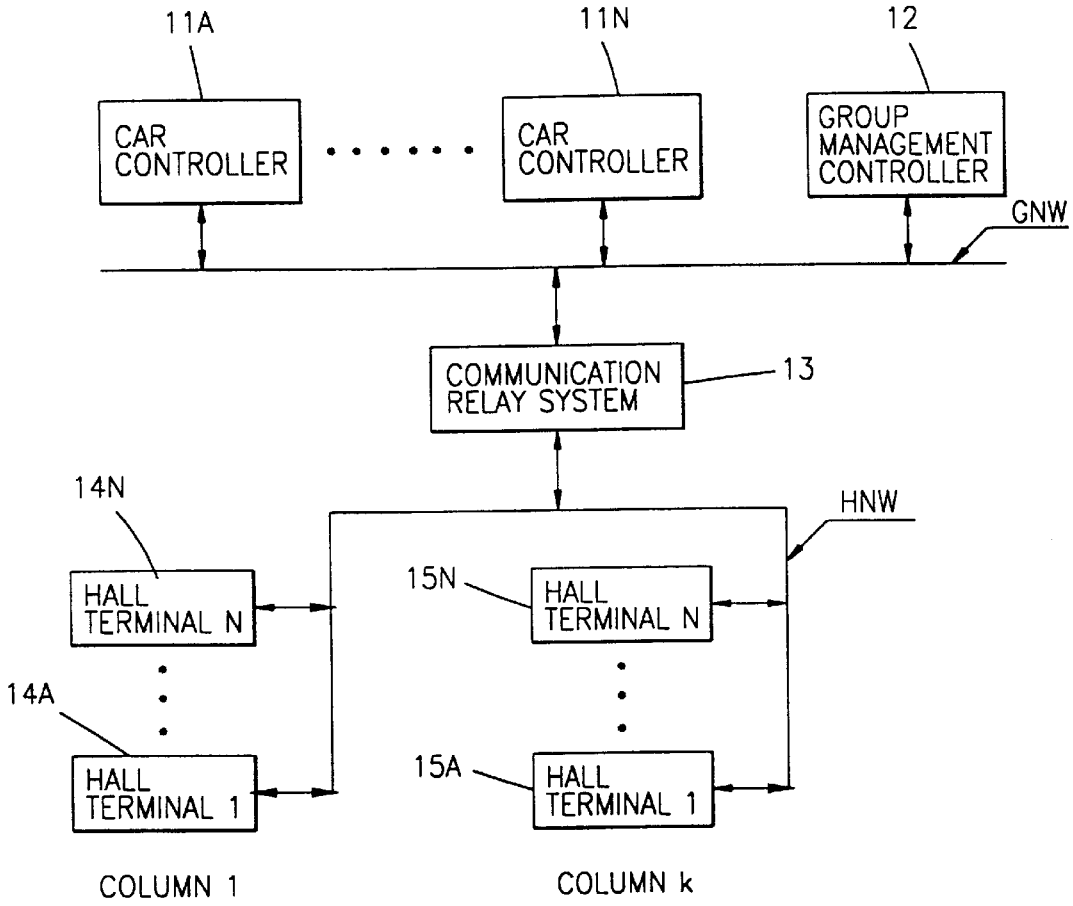
FIG. 1 CONVENTIONAL ART
FIG. 1 is a block diagram illustrating a communication apparatus for an elevator control system according to a conventional art.
Figure 2:
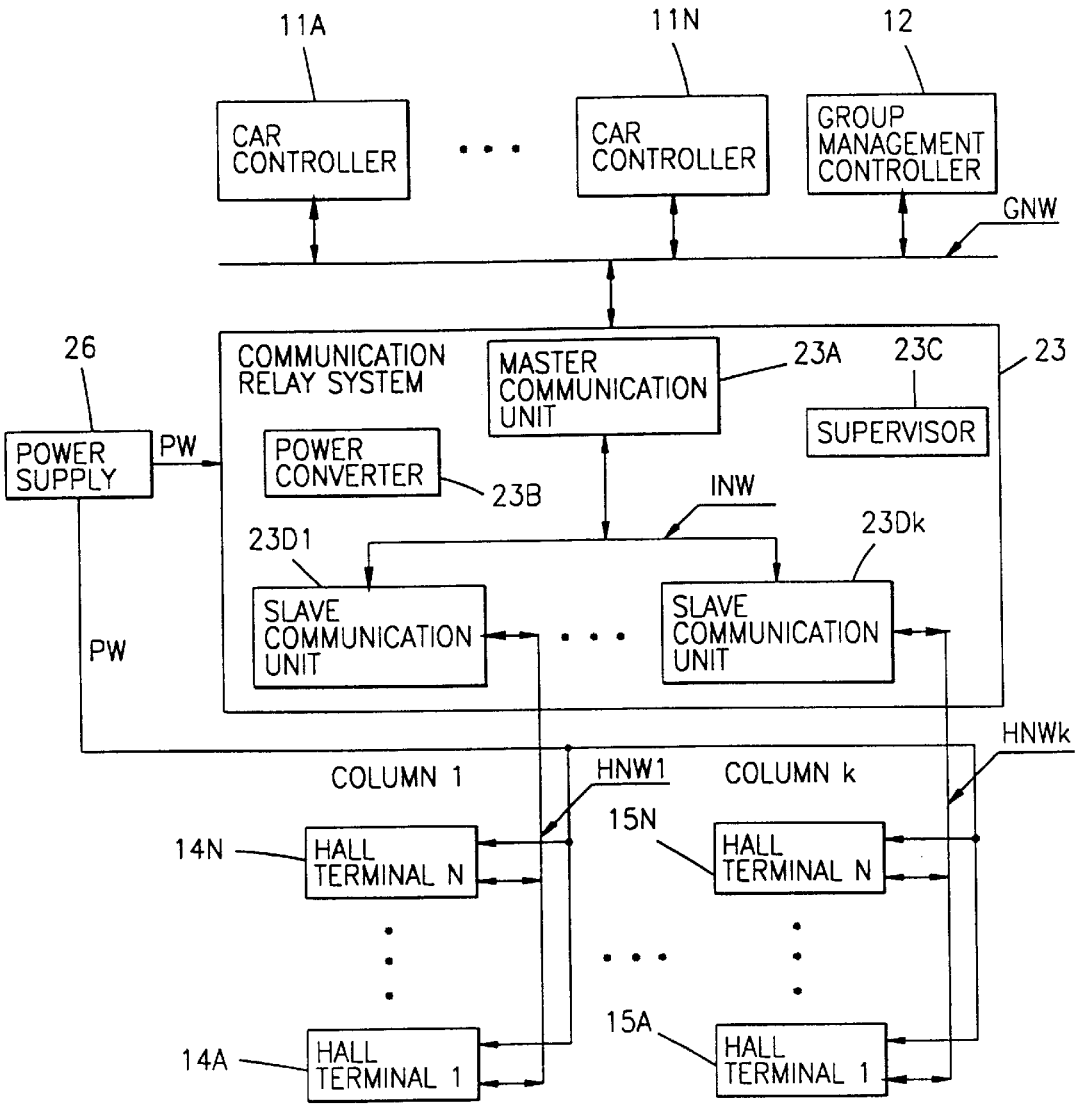
FIG. 2 is a block diagram illustrating a communication apparatus for an elevator control system according to a first embodiment of the present invention.

FIG. 2 is a block diagram illustrating a communication apparatus for an elevator control system according to a first embodiment of the present invention. As shown therein, the communication apparatus includes: a group management controller 12 for entirely controlling respective operations of a plurality of elevator cars; a plurality of car controllers 11A–11N for receiving output data of the group management controller 12 and controlling the respective operations of the elevator cars; a plurality of hall terminals 14A–14N, 15A–15N for being disposed at each of hall button units on each floor and receiving/transmitting car running data for their processing; a plurality of hall networks HNW1–HNWk for being disposed at each floor and connecting the hall terminals 14A–14N, 15A–15N with each other in parallel with respective call button columns (column 1–column k);

a communication relay system 23 for being separately connected with the plurality of hall networks HNW1–HNWk, receiving/transmitting data from/to the hall terminals 14A–14N, 15A–15N, and receiving/transmitting operational data through a group network GNW from/to the car controllers 11A–11N and the group management controller 12; a power supplier 26 for supplying electrical power to the communication relay system 23 and the respective hall terminals 14A–14N, 15A–15N.

Here. the group network GNW and the hall networks HNW1–HNWk are common serial transmission lines.

The communication relay system 23 includes: a plurality of slave communication units 23D1–23Dk for being separately connected to the plurality of hall networks HNW1–HNWk and receiving/transmitting data from/to the hall terminals 14A–14N, 15A–15N; a master communication unit 23A for receiving/transmitting through the group network GNW from/to the car controllers 11A–11N and the group management controller 12, and receiving/transmitting data through an internal network INW from/to the plurality of slave communication units 23D1–23Dk; a supervisor 23C for outputting a reset signal RESET when there occurs a breakdown in the slave communication units 23D1–23Dk and the master communication unit 23A; and a power converter 23B for receiving power from the power supplier 26 and providing a certain amount of power to required portions. Here, the internal network INW is a common serial transmission line.

The operation of the thusly constituted communication apparatus for an elevator control system according to the resent invention will now be explained.

The master communication unit 23A receives data transmitted through the group network GNW from the car controllers 11A–11N and the group management controller 12 towards halls, separately compiles the transmission data with regard to floors, call button unit columns, and outputs the processed data through the internal network INW to corresponding ones of the slave communication units 23D1–23Dk. The data received through the internal network INW from the slave communication units 23D1–23Dk are separated depending on floors, call button unit columns, thereby transmitting the resultant values to the car controllers 11A–11N and the group management controller 12.

The respective slave communication units 23D1–23Dk transmit the data received through the internal network INW to the hall terminals 14A–14N, 15A–15N through the respective hall networks HNW1–HNWk. That is, the slave communication unit 23D1 outputs data through the hall network HNW1 to the hall terminals 14A–14N, whereas the slave communication unit 23Dk outputs data through the hall network HNWk to the hall terminals 15A–15N.

Also, the respective slave communication units 23D1–23Dk transmit data of the hall terminals 14A–14N, 15A–15N applied thereto through the hall networks HNW1–HNWk to the master communication unit 23A.

The power supplier 26 receives a main power supply of the building which is received from the respective car controllers 11A–11N, and supplies through a power line PW a required power (AC or DC) required for operation of the communication relay system 23. The power converter 23B in the communication relay system 23 receives the supply power from the power supplier 26 and provides a driving voltage VCC required in respective portions of the communication relay system 23.

The supervisor 23C receives the driving voltage VCC of the power converter 23B, and if there has occurred an error in the driving voltage VCC, the master controller 23A and the slave communication units 23D1–23Dk are controlled accordingly, thereby preventing erroneous data from being loaded in any of the serial transmission paths GNW, HNW1–HNWk.

Also, the supervisor 23C outputs reset signal RESET to the master controller 23A or the slave communication units 23D1–23Dk or the hall terminals 14A–14N, 15A–15N in accordance with erroneous signals OUT1–OUT3, OUT5–OUT7 (discussed in detail below) from the master communication unit 23A, thereby improving the reliability with regard to the data which pass through the respective network GNW, HNW1–HNWk.

The master communication unit 23A separates the data received from the slave communication units 23D1–23Dk depending on floors and hall button unit columns by use of methods which will be described hereinafter. Meanwhile, the respective hall terminals 14A–14N, 15A–15N store therein identification numbers ID with regard to corresponding floors.

An address map is set in an internal memory and respective addresses for the address map identify stored data notifying which hall button unit column the respective slave communication units 23D1–23Dk is to control.

The format of data stored in the respective addresses is formed of identification numbers which correspond to respective floors and which correspond to respective hall button unit columns.

Under the above-described state, there will be employed two methods as follows.

With regard to a first method, when the plurality of hall terminals 14A–14N, 15A–15N output certain data along with their own identification numbers, the slave communication units 23D1–23Dk output the outputted data through internal network INW to the master communication unit 23A.

The master communication unit 23A compares the identification number included in the data inputted thereto with the data stored in its own address map, thereby determining which hall button unit column or which hall terminal the applied data are received from.

Therefore, the master communication unit 23A allows the data received from the slave communication units 23D1–23Dk to be compiled depending upon respective hall button unit columns and floors.

As a second method, the data stored in the internal address map is outputted to the respective slave communication units 23D1–23Dk which in turn store the data applied thereto in internal memory, and when data are received from the hall terminals 14A–14N, 15A–15N, its own data and the data stored in the internal memory are transmitted to the master communication unit 23A.

The data applied to the master communication unit 23A include the respective identification numbers of the respective hall terminals 14A–14N, 15A–15N and the corresponding column, so that the applied data without regard to any further compiling thereof are transmitted to the group network GNW.

Likewise, the respective slave communication units 23D1–23Dk are connected depending upon the hall button unit columns, and accordingly there is not required an identification number for discerning hall button unit columns connected to the hall terminals 14A–14N, 15A–15N, whereby a subsequent composition is not required and the composition of the hall terminals 14A–14N, 15A–15N becomes further simplified.

Figure 3:
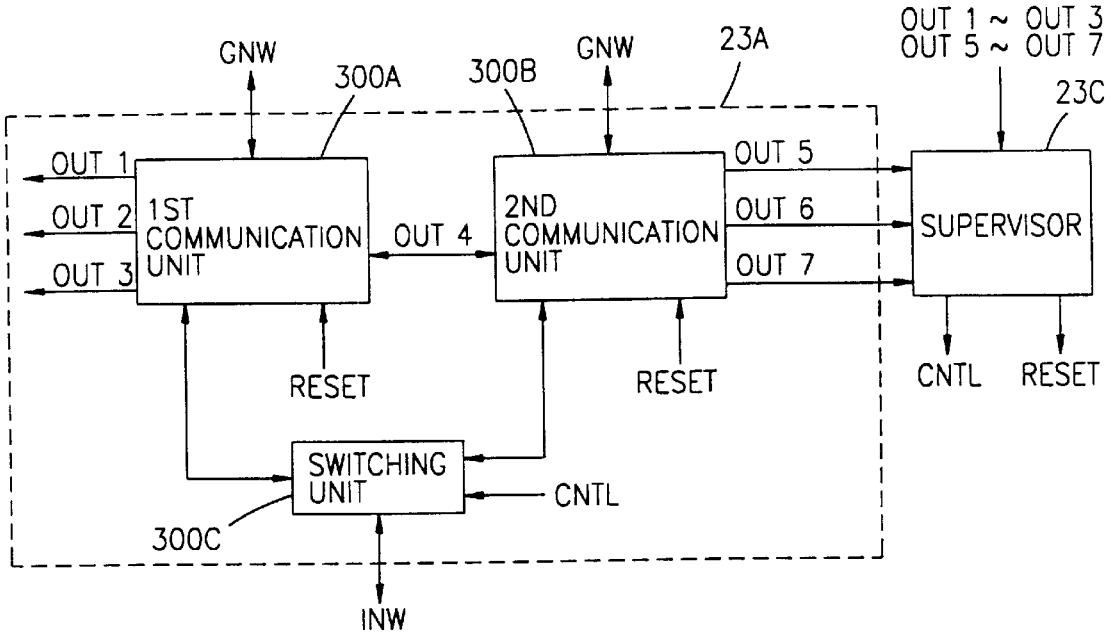
FIG. 3 is a block diagram detailing a mast communication unit in the diagram of FIG. 2.

As shown in FIG. 3, in order to increase a reliability with regard to a communication system, the master communication unit 23A is provided with a double system under an identical function thereof, and its operation will now be explained.

FIG. 3 is a block diagram detailing the master communication unit 23A.

As shown therein, the master communication unit 23A includes first and second communication units 300A, 300B for respectively carrying out a characteristic operation of the master communication unit 23A, and a switching unit 300C for selectively connecting the first communication unit 300A or the second communication unit 300B with the slave communication units 23D1–23Dk.

The first communication unit 300A outputs four error signals OUT1–OUT4, and the second communication unit 300B outputs four error signals OUT4–OUT7.

The error signal OUT1 denotes a signal with regard to an erroneous state of the second communication unit 300B, and it is outputted to the supervisor 23C.

The error signal OUT2 denotes a signal which notifies that the second communication unit 300B is not reset, and it is outputted to the supervisor 23C. The error signal OUT3 denotes a signal with regard to an erroneous state of the slave communication units 23D1–23Dk and it is outputted to the supervisor 23C. The error signal OUT4 denotes a signal with regard to the erroneous state of the communication unit (first or second) outputting the error signal OUT4.

The second communication unit 300B outputs the error signals OUT4–OUT7; wherein the error signal OUT5 corresponds to the error signal OUT1, the erroneous signa OUT6 corresponds to the error signal OUT2, and the error signal OUT7 corresponds to the error signal OUT3.

The operation of the thusly provided composition is carried out in three ways as follows.

Figure 4:
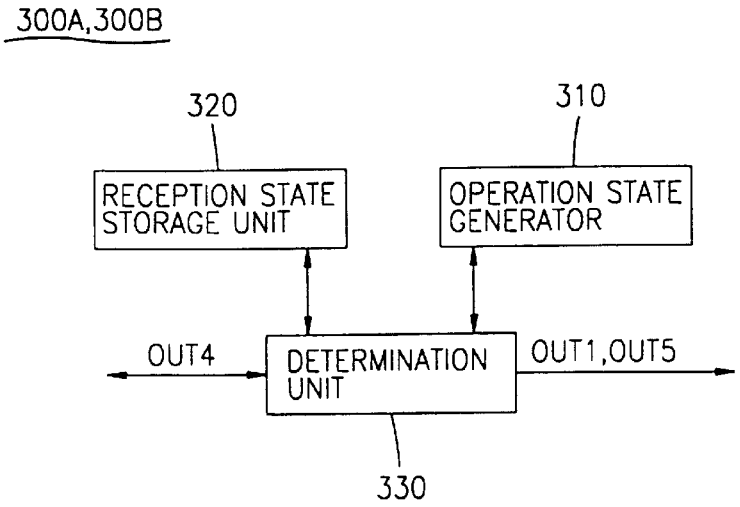
FIG. 4 is a block diagram illustrating a first or second communication unit for determining whether its counterpart communication unit is erroneous, according to the present invention.

Firstly, the respective communication units 300A, 300B respectively output erroneous states to its counterpart communication unit in the form of the error signal OUT4. In accordance with the error signal OUT4, if it is determined that the counterpart communication unit is erroneous, the error signals OUT1, OUT5 are outputted to the supervisor 23C and accordingly the supervisor 23C in turn outputs reset signal RESET which enables the erroneous communication unit to be reset. Here, the further required composition is as shown in FIG. 4.

Figure 5:
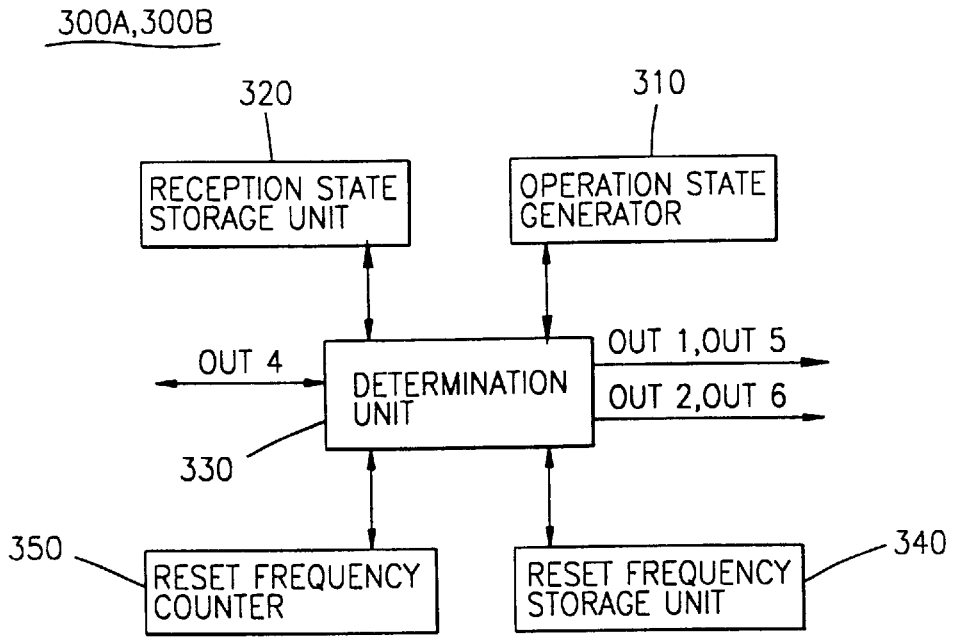
FIG. 5 is a block diagram illustrating a first or second communication unit for determining whether a counterpart communication unit is erroneous and reset, according to the present invention.

Secondly, in addition to the first composition, if the counterpart communication unit is not reset by reset signal RESET of the supervisor 23C, that is, if the erroneous state is not solved, the communication units 300A, 300B output the error signals OUT2, OUT6 to the supervisor 23C which accordingly outputs a switching signal CNTL to the switching unit 300C which serves to shift the connection of the internal network INW. Here, the further required composition is as shown in FIG. 5.

Figure 6:
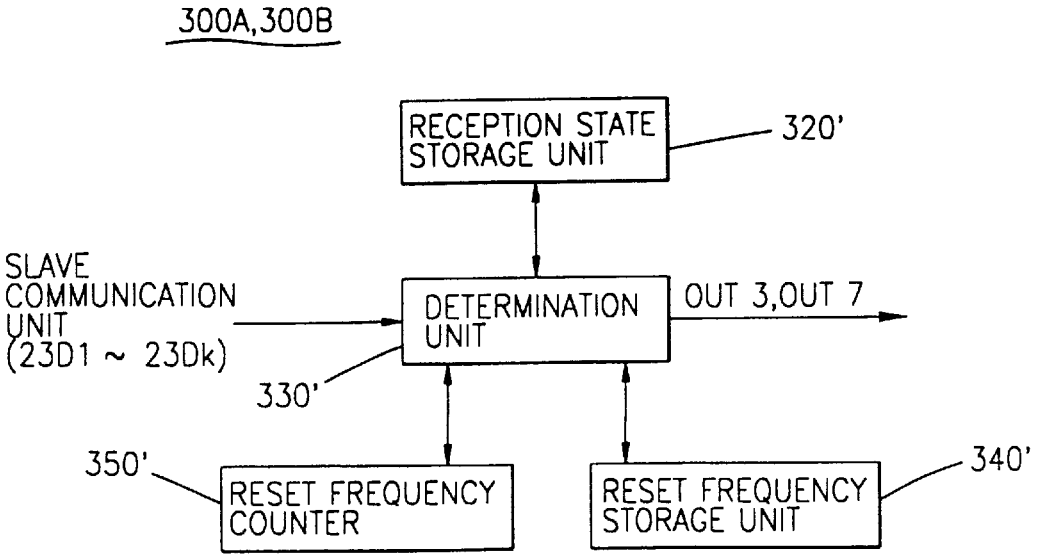
FIG. 6 is a block diagram illustrating a first or second communication unit for determining whether a slave communication unit is erroneous, according to the present invention.

Thirdly, the respective communication units 300A, 300B respectively output the erroneous states of the slave communication units 23D1–23Dk to the supervisor 23C in the form of the error signals OUT3, OUT7. Accordingly, the supervisor 23C serves to reset the slave communication units 23D1–23Dk. Here, the further required composition is as shown in FIG. 6.

The above-described three operations will be described with reference to FIG. 10.

Figure 10:
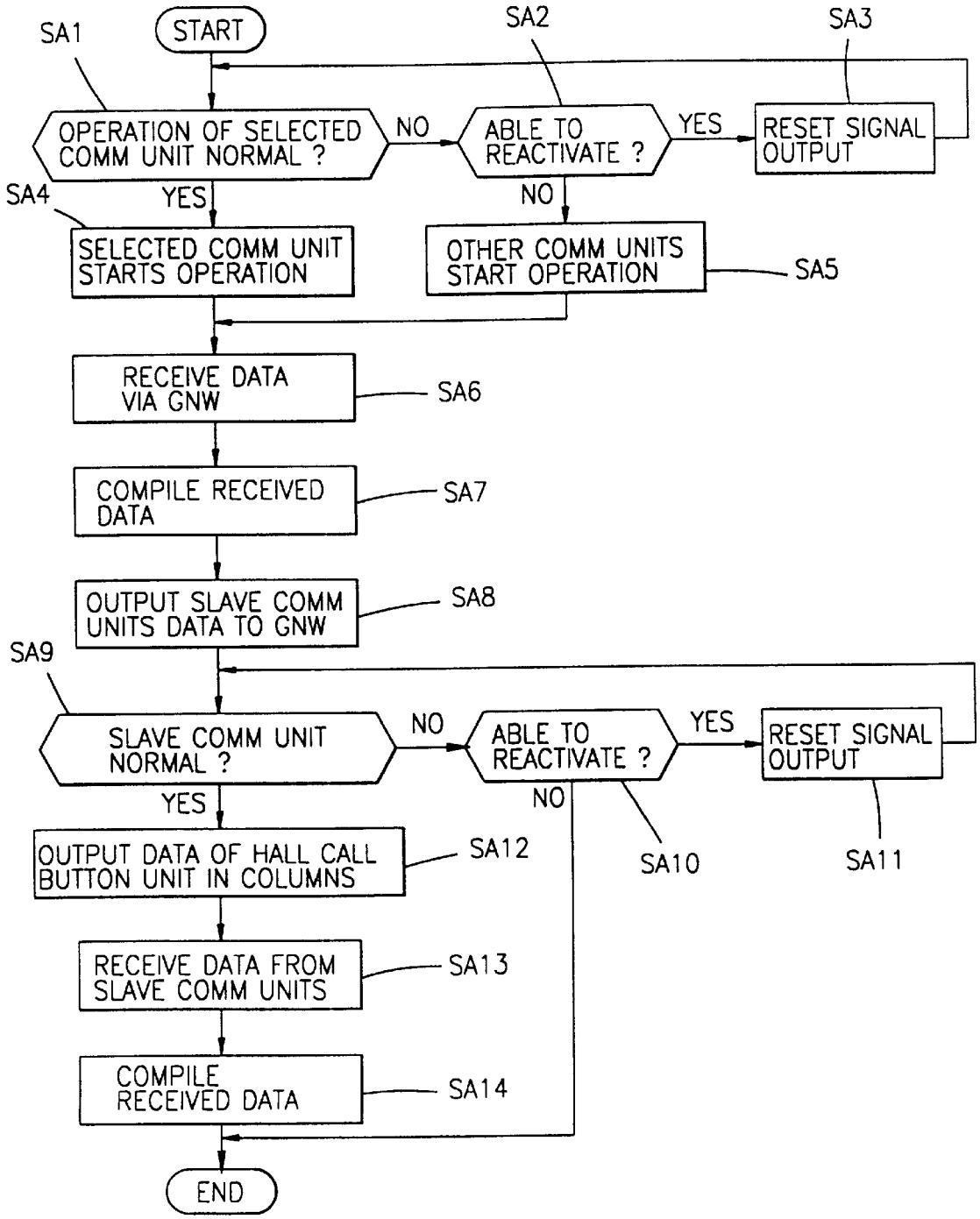
FIG. 10 is a flow chart illustrating respective operations of a master communication unit according to the present invention.

FIG. 10 is a flow chart illustrating operations of the master communication 23A according to the present invention.

Step SA1 in FIG. 10 is accomplished in accordance with the composition in FIG. 4.

As shown therein, the first communication unit 300A or the second communication unit 300B includes: an operation state generator 310 for differentiating respective output values in a previous step and in a next step per predetermined cycle for thereby displaying whether there is an error in its own operational state and outputting the resultant value; a reception state storage unit 320 for storing therein a data value corresponding to the error signal OUT4 received formed the counterpart communication unit; and a determination unit 330 for storing in the reception state storage unit 320 the data value corresponding to the error signal OUT4, comparing the stored data value with a data value previously stored in the reception state storage unit 320, determining whether the counterpart communication unit is in a normal state, and outputting the error signals OUT1, OUT5 to the supervisor 23C when the counterpart communication unit is not in a normal state.

The operation of the master communication unit 23A will now be described. Here, for convenience's sake, it is assumed that the operational state of the first communication unit 300A is supervised by the second communication unit 300B.

The operational state generator 310 of the first communication unit 300A alternately outputs a data value of "0", and "1". For the sake of the description, it is assumed that there is outputted a data value "0".

The determination unit 330 in the first communication unit 300A outputs the data value "0", serving as the error signal OUT4 to the counterpart communication unit 300B, and the determination unit 330 in the second communication unit 300B which has received the error signal OUT4 stores the erroneous signal "0" in the reception state storage unit 320.

In the next step, the operational state generator 310 outputs a data value "1" which is contrary to the data value "0", and the determination unit 330 in the second communication unit 300B that has received the error signal OUT4 which corresponds to the data signal "1" compares the data signal "1" with the previously stored data signal "0". Because the two values are not identical, the determination unit 330 in the second communication unit 300B determines that the first communication unit 300A is in a normal operation.

If the two value are identical, the determination unit 330 determined that the first communication unit 300A is in an abnormal state. Here, the abnormal state of the first communication unit 300A is that the operational state determination unit 310 in the first communication unit 300A is not able to alternately output the data values "0", and "1", or that the determination unit 330 in the first communication unit 300A is not able to normally output the data value.

In this case, the determination unit 330 in the second communication unit 300B determines that an error has occurred in the first communication unit 300A in accordance with the error signal OUT4, whereby the resultant value is outputted in the form of the error signal OUT5, and when the error signal OUT5 is applied, the supervisor 23C outputs a reset signal RESET to the first communication unit 300A. Here, if there is not any erroneous state, the first communication unit 300A becomes reset.

Meanwhile, the system composition may vary to a different type in which the determination unit 330 outputs the error signals OUT1, OUT5 to an external display device (not shown), in which composition a building supervisor may be able to directly check whether there is an error in any of the communication units.

FIG. 5 is a block diagram illustrating a composition of the first communication unit 300A or the second communication unit 300B for determining whether the counterpart communication unit remains erroneous and reset, according to the present invention, wherein the reset frequency counter storage unit 340 and the reset frequency counter 350 are provided therein in addition to the composition to FIG. 4, and wherein steps SA2, SA3 are carried out in accordance therewith.

The reset frequency storage unit 340 is previously stored by the reset frequency value. Here, the reset frequency denotes a number which determines how many times the counterpart communication unit will reset the counterpart communication unit. In order to reset the counterpart communication unit, the determination unit 330 corresponds to an output frequency number of the error signals OUT1, OUT5, and in the present description the output frequency number is set as "3". The reset frequency counter 350 counts how many times the error signals OUT1, OUT5 are thus far outputted therefrom so as to reset the counter communication unit.

The determination unit 330 determines whether there is an error with regard to the counterpart communication unit, thereby outputting the error signals OUT5, OUT1 to the supervisor 23C. Then, a value "1" is stored in the reset frequency counter 350. The value "1" denotes that the error signal (OUT5 or OUT1) is once outputted.

When the communication unit which became erroneous due to the reset signal RESET outputted from the supervisor 23C is not restored, the error signal OUT4 is once again received from the determination unit of the communication unit which is not restored.

The determination unit 330 determines whether there is an error in the counterpart communication unit by the error signal OUT4, and when an error is detected after the determination, the value "1" stored in the reset frequency counter 350 and the frequency number "3" stored in the reset frequency storage unit 340 are compared with each other.

If the comparison proves not identical, the error signal (OUT5 or OUT1) is outputted to the supervisor 23C, and a value "2" is stored in the reset frequency counter 350. Thus far the error signal (OUT5 or OUT1) has been outputted two times.

When the determination unit 330 outputs the error signal (OUT5 or OUT1) three times, the value stored in the reset frequency counter 350 becomes "3". Thereafter, when it is determined that there is an error in the counterpart communication unit, the determination unit 330 compares the value "3" stored in the reset frequency counter 350 and the value "3" stored in the reset frequency storage unit 340.

Likewise, when the compare two values prove identical, the determination unit 330 outputs the error signal (OUT6 or OUT2) to the supervisor 23C. The supervisor 23C, when the error signal (OUT6 or OUT2) is inputted, outputs the switching signal CNTL to the switching unit 300C. Accordingly, the switching unit 300C modifies the connection of the internal network INW. Therefore, the internal network INW which was connected to the communication unit in which an error has occurred is connected another communication unit. Therefore, the determination unit 330 allows the supervisor 23C to output the reset signal RESET three times in succession to the communication unit in which there occurred an error. If the error is not restored even after the above process, it is determined that the reset operation of the supervisor 23C does not guarantee the resetting, whereby the connection of the communication unit is switched.

FIG. 6 is a block diagram illustrating the first communication unit 300A or the second communication unit 300B for determining whether the slave communication units 23D1–23Dk are erroneous, according to the present invention, wherein the steps SA9–SA11 in FIG. 10 are carried out accordingly.

The reception state storage unit 320' stores the data corresponding to an error signal received from the slave communication units 23D1–23Dk via the internal networks INW. The reset frequency storage unit 340' stores by the reset frequency number. Here, the reset frequency number denotes a number that determines how many times the slave communication units 23D1–23Dk should be reset in succession, and which corresponds to the frequency number for the determination unit 330 to output the error signals OUT3, OUT7; in the present description, the frequency number is set as "3". The reset frequency counter 350' counts the frequency number of the error signals OUT3, OUT7 thus far for resetting the slave communication units 23D1–23Dk.

The determination unit 330' determines whether the slave communication units 23D1–23Dk are erroneous, outputs the error signal (OUT3 or OUT7) to the supervisor 23C, and stores the value "1" in the reset frequency counter 350'. The value "1" indicates that the error signal (OUT5 or OUT1) is outputted once.

The operation with regard to FIG. 6 will now be described.

The slave communication units 23D1–23Dk alternately output data values "0", "1", and the outputted data values are stored in the reception state storage unit 320'. Once the slave communication units 23D1–23Dk output the data once again, the determination unit 330' compares the data with the data previously stored in the reception state storage unit 320'. If the two values are not identical, it is determined that the slave communication units 23D1–23Dk are in normal operation, and if the two values are identical, the error signal (OUT3 or OUT7) is outputted to the supervisor 23C, and then the value "1" is stored in the reset frequency counter 350.

The supervisor 23C outputs the reset signal RESET to the slave communication units 23D1–23Dk.

When the resetting of the slave communication units 23D1–23Dk is repeated three times, the value "3" stored in the reset frequency counter 350' and the value stored in the reset frequency storage unit 340' become identical to each other. At this time, the determination unit 330' determines that it is impossible to communicate with the slave communication units 23D1–23Dk, thereby interrupting the communication with corresponding ones of the slave communication units 23D1–23Dk.

Figure 11:
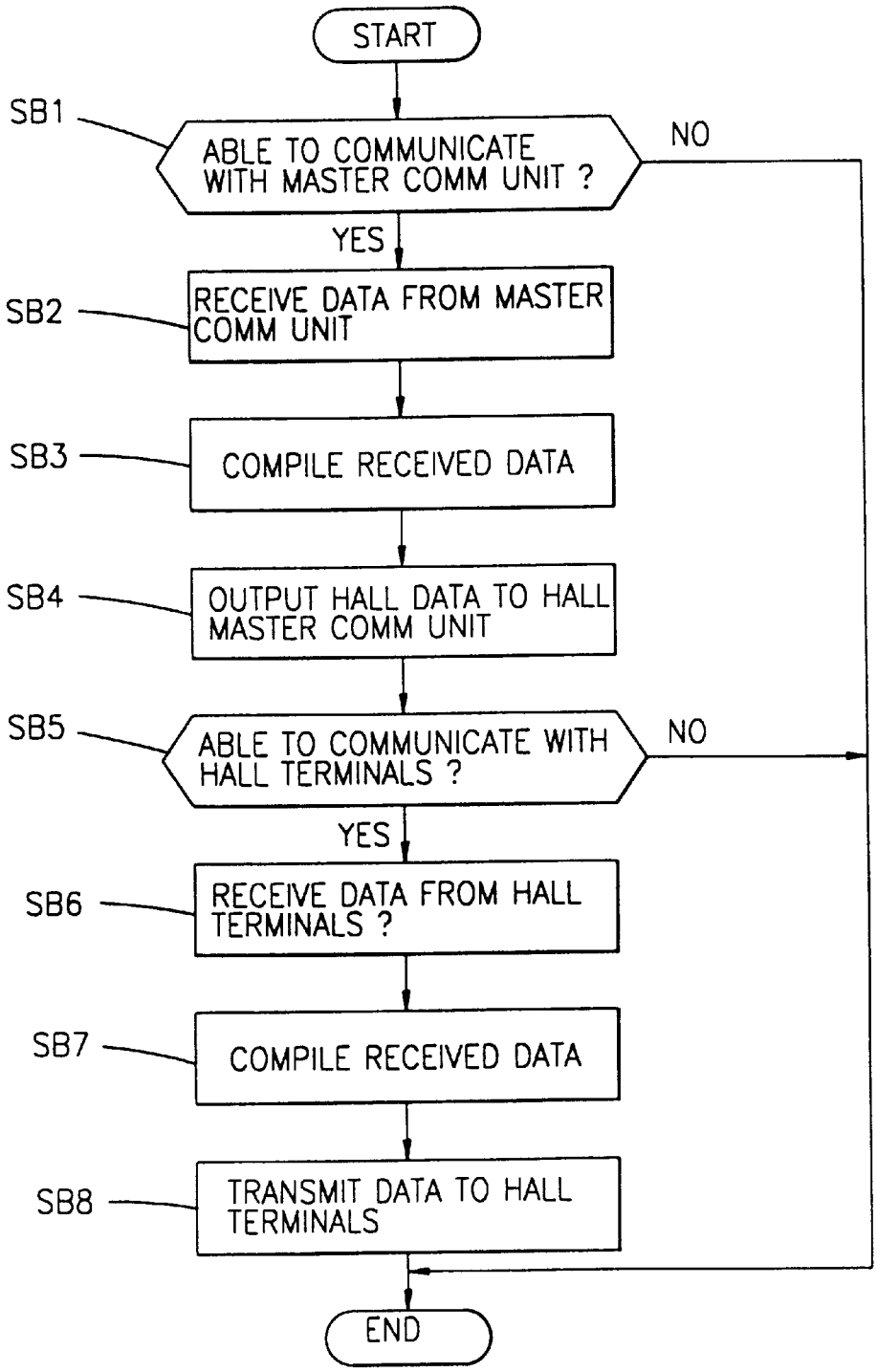
FIG. 11 is a flow chart illustrating respective operations of slave communication units according to the present invention.

The explanation thus far was about the operations of the master communication unit 23A and the supervisor 23C according to the double system with regard to the master communication unit 23A. Next, the operation of the slave communication units 23D1–23Dk for enhancing a communication reliability will now be described with reference to FIG. 11 illustrating the operational steps of the slave communication units 23D1–23Dk according to the present invention.

Prior to carrying out a data communication, the respective slave communication units 23D1–23Dk determine whether it is possible to communicate with the master communication unit 23A connected to the internal network INW, and also determine whether it is possible to communicate with the hall terminals 14A–14N, 15A–15N connected to the hall networks HNW1–HNWk.

Initially, referring to FIG. 7, there will be explained operations for determining whether it is possible for the slave communication units 23D1–23Dk to communicate with the master communication unit 23A, which corresponds to the step SB1 in FIG. 11.

Each of the slave communication units 23D1–23Dk includes: a confirmed signal generator 231 for differentiating respective output values in a previous step and in a next step per predetermined cycle and outputting the resultant value; a confirmed signal storage unit 232 for storing therein a data value corresponding to the confirmed signal received from the master communication unit 23A; and a determination unit 233 for storing in the confirmed signal storage unit 232 the data value corresponding to the confirmed signal received from the master communication unit 23A, comparing the stored data value with a data value previously stored in the confirmed signal storage unit 232, and determining whether it is possible to communicate with the master communication unit 23A.

The operation of the slave communication units 23D1–23Dk will now be described.

The confirmed signal generator 231 outputs the value "0" or "1" and the determination unit 233 converts the data into the confirmed signal, outputs the converted signal to the master communication unit 23A and stores the resultant value in the confirmed signal storage unit 232. The master communication unit 23A outputs another confirmed signal having a data value identical to the previous confirmed signal. The determination unit 233 compares the value of the confirmed signal outputted from the master communication unit 23A with the confirmed signal stored in the confirmed signal storage unit 232. If the two value are identical, it may be understood that the slave communication units 23D1–23Dk are able to communicate with the master communication unit 23A. If the two values are different from each other, the slave communication units 23D1–23Dk halt the communication with the master communication unit 23A.

Next, the operations for determining whether it is possible for the slave communication units 23D1–23Dk to communicate with the hall terminals 14A–14N, 15A–15N will be explained with reference to FIG. 8, which corresponds to the step SB5 in FIG. 11.

Figure 7:
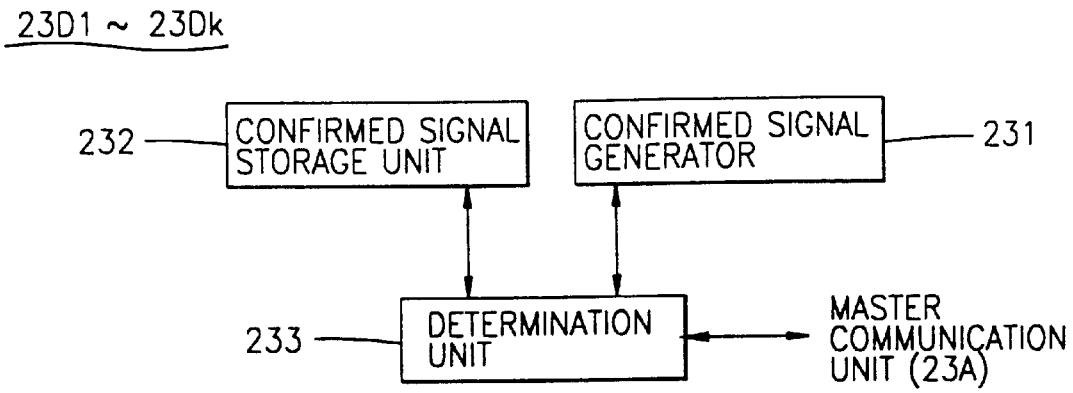
FIG. 7 is a block diagram illustrating a slave communication unit for determining whether to communicate with the master communication unit.
Figure 8:
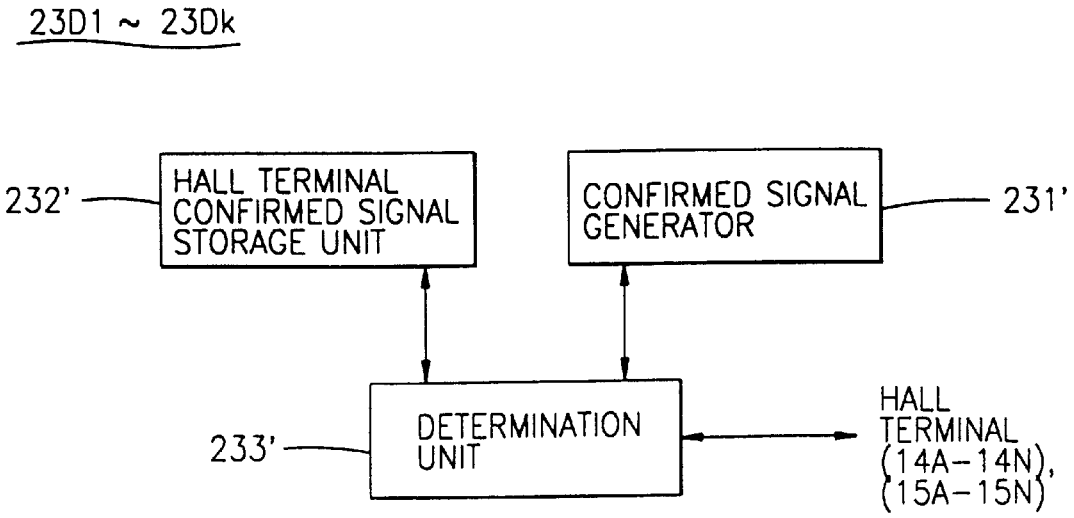
FIG. 8 is a block diagram illustrating a slave communication unit for determining whether to communicate with hall terminals.

The confirmed signal generator 231' as shown in FIG. 8 corresponds to the confirmed signal generator 231 in FIG. 7, and the hall terminal confirmed signal storage unit 232' corresponds to the confirmed signal storage unit 232 in FIG. 7, and also the determination unit 233' corresponds to the determination unit 233 in FIG. 7.

The confirmed signal generator 231' outputs the value "0" or "1", and the determination unit 233' converts the outputted value to the confirmed signal and outputs the converted value to the hall terminals 14A–14N, 15A–15N, and then the resultant value is stored in the hall terminal confirmed signal storage unit 232'. The hall terminals 14A–14N, 15A–15N respectively output a confirmed signal having a signal identical to the previous confirmed signal. The determination unit 233 compares the confirmed signal value outputted from the hall terminals 14A–14N, 15A–15N with the confirmed signal stored in the hall terminal confirmed signal storage unit 232. If the two values are identical, it means that it is possible for the hall terminals 14A–14N, 15A–15N to communicate with the master communication unit 23A. If the communication is not normal, the two values for comparison become different from each other, in which case the slave communication units 23D1–23Dk stop the communication with the hall terminals 14A–14N, 15A–15N.

Figure 9:
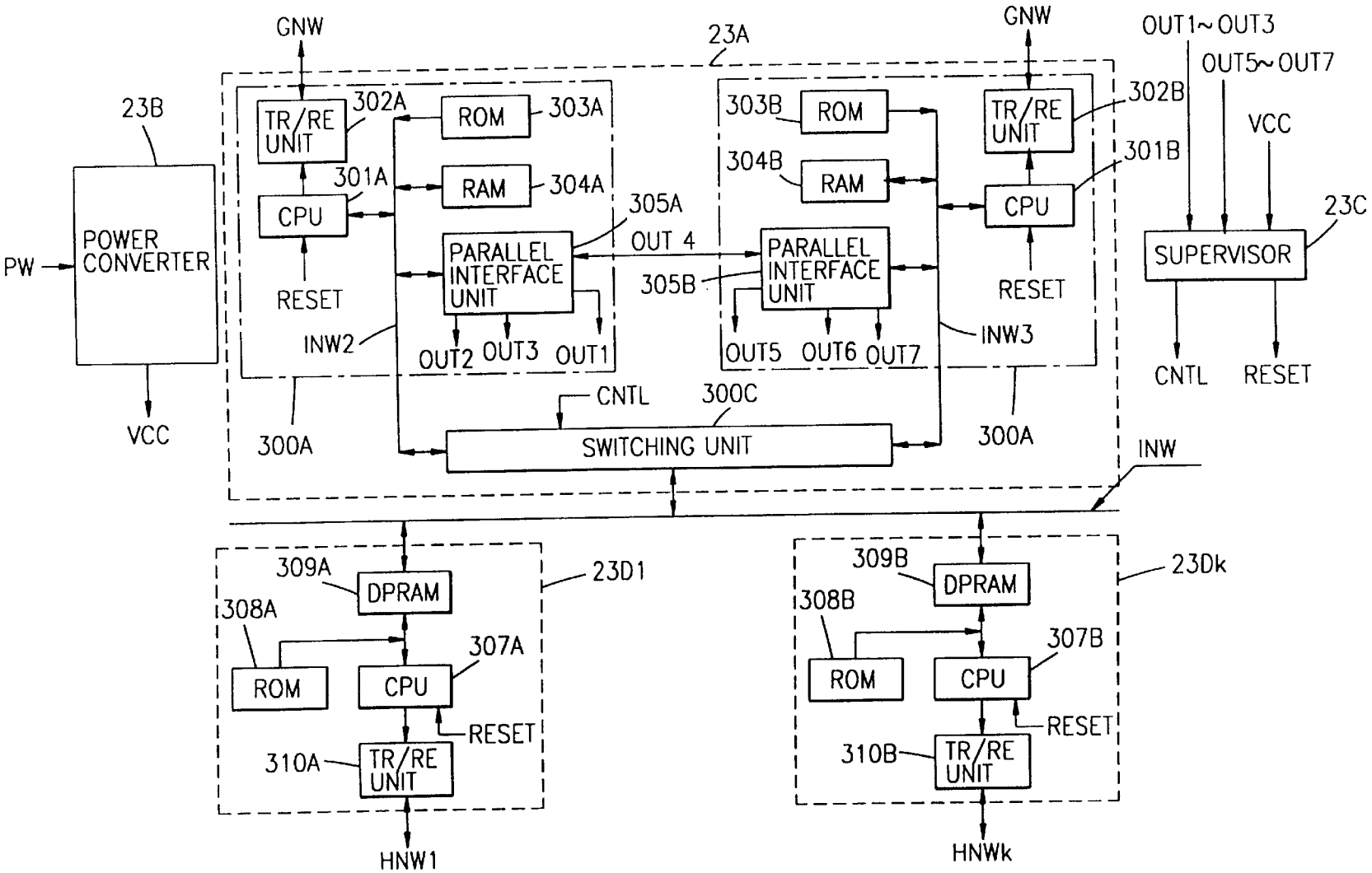
FIG. 9 is a block diagram illustrating hardware realizing a communication relay system according to the present invention.

FIG. 9 is a block diagram illustrating a hardware realizing the communication relay system 23A according to the present invention. As shown therein, each of the first communication unit 300A and the second communication unit 300B includes: CPUs 301A, 301B; ROMs 303A, 303B storing therein programs; RAMs 304A, 304B serving as working spaces for carrying out the programs; parallel interface units 305A, 305B; and the reception/transmission units 302A, 302B for respectively coupling the CPUs 301A, 301B to the group network GNW.

The CPUs 301A, 301B carry out functions for determination units 330, 330'. The ROMs 303A, 303B carry out functions for the operation state generator 310 and the reset frequency storage units 340, 340'. The RAMs 304A, 304B carry out functions for the reception state storage unit 320, 320' and the reset frequency counter 350, 350'.

The parallel interface unit 305A outputs the error signal OUT4 to the parallel interface unit 305B in the second communication unit 300B in accordance with the process result from the CPU 301A, and outputs the error signals OUT1–OUT3 to the supervisor 23C. Also, the parallel interface unit 305B outputs the error signal OUT4 to the parallel interface unit 305B in accordance with the process result from the CPU 301B, and outputs the error signals OUT5–OUT7 to the supervisor 23C.

Each of the slave communication units 23D1–23Dk includes: CPUs 307A, 307B; ROMs 308A, 308B storing therein programs; a DPRAM (Dual Port RAM) 309A, 309B for communicating with the master communication unit 23A serving as a working space for carrying out programs; and reception/transmission units 310A, 310B for respectively coupling the CPUs 307A, 307B to the hall networks HNW1–HNWk.

The CPUs 307A, 307B carry out functions for determination units 233, 233'. The ROMs 308A, 308B carry out functions for the confirmed signal generator 231. The DPRAMs 309A, 309B carry out functions for the confirmed signal storage unit 232 and the hall terminal confirmed signal storage unit 232'.

Figure 12:
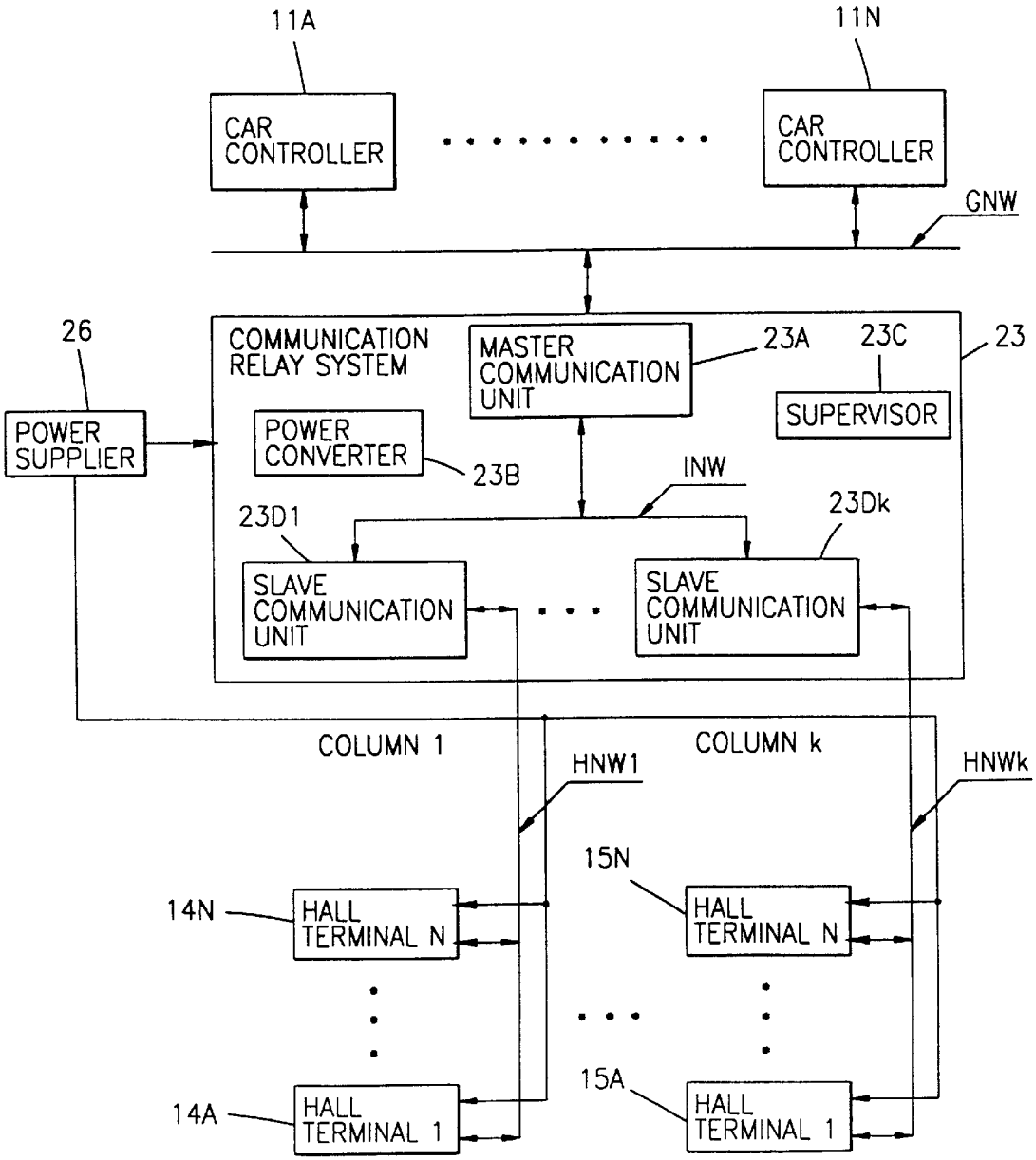
FIG. 12 is a block diagram illustrating a communication apparatus for an elevator control system according to a second embodiment of the present invention.

FIG. 12 is a block diagram illustrating the communication apparatus for an elevator control system according to the second embodiment of the present invention, wherein the group management controller 12 as employed in the first embodiment of the present invention is not adopted and instead the most significant one in order among the car controllers 11A–11N is selected as a master car controller which then carries out the group management control.

The communication apparatus for an elevator control system according to the present invention realizes a technology in which the data signals outputted from the plurality of car controllers 11A–11N or the group management controller 12 are received and processed through the group network GNW, and the processed signals are transmitted to the hall terminals 14A–14N, 15A–15N. To the contrary, the data values outputted from the hall terminals 14A–14N, 15A–15N are transmitted through the group network GNW. Therefore, it is not important whether the group management controller 12 carries out the group management function or the group management function is carried out by any of the plurality of car controllers 11A–11N. Accordingly, the present invention is applicable either to an elevator system including the car controllers 11A–11N and the group management controller 12 or to an elevator system only including the car controllers 11A–11N.

As described above, the communication apparatus for an elevator control system according to the present invention is provided with a double system including the first and second communication units which are identically operated in the communication relay system. The apparatus also includes the slave communication units in respective hall button unit columns, and the plurality of hall terminals and the slave communication unit are coupled to a common serial transmission line serving as the hall network, thereby independently controlling the hall terminals.

Further, the thusly simplified method for determining respective identification number of the hall terminals improves reliability in communication.

Still further, the power supply for the communication relay system and the respective hall terminals and the other power supply for the car controllers are separately provided in the system, thereby stabilizing the power supply mechanism.

As the present invention may be embodied in several forms without departing from the spirit of essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within meets and bounds of the claims, or equivalences of such meets and bounds are therefore intended to embrace the appended claims.

What is claimed is:

1. An elevator control system, comprising:

a plurality of car controllers which control respective operations of a plurality of elevator cars;

at least one column of hall terminals, each hall terminal disposed at a floor of the building and controlling input/output operations of at least a hall call button unit at the floor of the building, each column of hall terminals associated with at least a column of the hall call button units;

a communication relay system for relaying communications between the plurality of car controllers and the plurality of hall terminals, the communicating relay system including, a slave communication unit corresponding to each column of hall terminals and receiving/transmitting data from/to the corresponding column of hall terminals, and a master communication unit for receiving/transmitting data from/to the plurality of car controllers and each slave communication unit.

2. The system of claim 1, wherein each of the hall terminals includes data with regard to a corresponding floor thereof, and the master communication unit stores therein data with regard to the hall button unit columns for controlling the respective slave communication units, compares the stored data with hall terminal data outputted from the slave communication units, and determines which hall terminal the hall terminal data are received from.

3. The system of claim 1, wherein each of the hall terminals includes data with regard to a corresponding floor thereof, the master communication unit outputs data regarding the columns of the hall button units to the slave communication units, and each slave communication unit outputs the data for the associated column of the hall button units to the corresponding column of hall terminals.

4. The system of claim 1, further comprising:

a power supply for receiving a main supply power of the building and supplying a required power with regard to respective operations of the hall terminals; and a power converter for receiving a supply power from the power supply and supplying a required operational power to relevant portions in the communication relay system.

5. The system of claim 1, further comprising:

a hall serial communication line associated with each column of hall terminals, and connecting the associated hall terminals to the corresponding slave communication unit;

a common serial communication line connecting the communication relay system and the plurality of car controllers; and wherein the communication relay system further includes an internal serial communication line connecting each slave communication unit to the master communication unit.

6. The system of claim 1, wherein the master communication unit comprises:

a first communication unit; and a second communication unit; and wherein the first communication unit generates a first bit stream, receives a second bit stream from the second communication unit, compares a currently received portion of the second bit stream with a previously received portion of the second bit stream, determines whether the second communication unit is in a normal state based on the comparison, and outputs a first error signal when the second communication unit is not operating in a normal state; and the second communication unit generates the second bit stream, receives the first bit stream from the first communication unit, compares a currently received portion of the first bit stream with a previously received portion of the first bit stream, determines whether the first communication unit is in a normal state based on the comparison, and outputs a second error signal when the first communication unit is not operating in a normal state.

7. The system of claim 6, wherein the communication relay system comprises:

a supervisor receiving the first and second error signals, outputting a first reset signal to reset the second communication unit when the first error signal is received, and outputting a second reset signal to reset the first communication unit when the second error signal is received.

8. The system of claim 7, wherein the communication relay system further comprises:

a switch selectively communicating one of the first and second communications units with the slave communication units.

9. The system of claim 8, wherein the first communication unit stores a first predetermined total error value, counts a first number of times the first error signal is output, and outputs a third error signal when the first number of times equals the first predetermined total error value;

the second communication unit stores a second predetermined total error value, counts a second number of times the second error signal is output, and outputs a fourth error signal when the second number of times equals the second predetermined total error value; and the supervisor causes the switch to communicate the first communication unit with the slave communication units in response to the fourth error signal, and causes the switch to communicate the second communication unit with the slave communication units in response to the third error signal.

10. The system of claim 1, wherein the master communication unit comprises:

a first communication unit; and a second communication unit; and wherein at least one of the first and second communication units receives a bit stream from the slave communication units, and compares a currently received portion of the bit stream with a previously received portion of the bit stream, determines whether the slave communication units are in a normal state based on the comparison, and outputs an error signal when the slave communication units are not in the normal state.

11. The system of claim 10, wherein the communication relay system comprises:

a supervisor receiving the error signal and outputting a reset signal to reset the slave communication unit.

12. The system of claim 11, wherein the at least one of the first and second communication units stores a predetermined total error value, counts a number of times the error signal is output, and interrupts communication with the slave communication units when the number of times equals the predetermined total error value.

13. The system of claim 1, wherein the slave communication units receive a bit stream from the master communication unit, compare a currently received portion of the bit stream with a previously received portion of the bit stream, and determine whether to communicate with the master communication unit based on the comparison.

14. The system of claim 1, wherein each of the slave communication units receives a bit stream from the corresponding column of the hall terminals, compares a currently received portion of the bit stream with a previously received portion of the bit stream, and determines whether to communicate with the corresponding column of hall terminals based on the comparison.

15. The system of claim 1, further comprising:

a power supply for receiving a main supply power of the building and supplying a required power with regard to respective operations of the hall terminals; and a power converter for receiving a supply power from the power supply and supplying a required operational power to relevant portions in the communication relay system.

* * * * *

UNITED STATES PATENT AND TRADEMARK OFFICE

CERTIFICATE OF CORRECTION

PATENT NO. : 5,936,211
DATED : August 10, 1999
INVENTOR(S) : Yeon Hun Kim

It is certified that error appears in the above-identified patent and that said Letters Patent is hereby corrected as shown below:

Title page,
Item [30], Foreign Application Priority Data, the priority date of "KR 96/66645" should be -- Dec. 17, 1996 -- instead of "Dec. 17, 1986".

Signed and Sealed this

Twenty-first Day of June, 2005

JON W. DUDAS
*Director of the United States Patent and Trademark Office*